US012029373B2

(12) United States Patent
Dirnberger et al.

(10) Patent No.: US 12,029,373 B2
(45) Date of Patent: Jul. 9, 2024

(54) DOMESTIC DISHWASHER AND DOSING SYSTEM THEREFOR

(71) Applicant: emz-Hanauer GmbH & Co. KGaA, Nabburg (DE)

(72) Inventors: Albert Dirnberger, Neunburg vorm Wald (DE); Georg Spiessl, Altendorf (DE); Sophia Grimm, Schmidgaden/Trisching (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 353 days.

(21) Appl. No.: 17/336,662

(22) Filed: Jun. 2, 2021

(65) Prior Publication Data

US 2021/0378482 A1 Dec. 9, 2021

(30) Foreign Application Priority Data

Jun. 9, 2020 (DE) ..... 102020115319.8
Oct. 30, 2020 (DE) ..... 102020128650.3

(51) Int. Cl.
*A47L 15/42* (2006.01)
*A47L 15/44* (2006.01)

(52) U.S. Cl.
CPC ..... *A47L 15/449* (2013.01); *A47L 15/4257* (2013.01); *A47L 15/4297* (2013.01); *A47L 15/4436* (2013.01); *A47L 15/4463* (2013.01); *A47L 2401/10* (2013.01); *A47L 2501/07* (2013.01); *A47L 2501/36* (2013.01)

(58) Field of Classification Search
None
See application file for complete search history.

(56) References Cited

U.S. PATENT DOCUMENTS

| | | | | |
|---|---|---|---|---|
| 6,701,944 | B2 | 3/2004 | McNabb et al. | |
| 2015/0075563 | A1* | 3/2015 | Marone | A47L 15/4409 134/102.1 |
| 2020/0093346 | A1 | 3/2020 | Lutz et al. | |

FOREIGN PATENT DOCUMENTS

| | | | |
|---|---|---|---|
| CN | 109700410 | A | 5/2019 |
| DE | 4344205 | A1 | 6/1995 |
| DE | 19540958 | A1 | 5/1997 |
| WO | 02058528 | A1 | 8/2002 |

* cited by examiner

*Primary Examiner* — Levon J Shahinian
(74) *Attorney, Agent, or Firm* — Hayes Soloway PC

(57) ABSTRACT

A dosing system for installation in a domestic dishwasher is disclosed. The dosing system in some embodiments permits the automated delivery of a defined dose of a detergent in powder form into a dishwashing chamber of the dishwasher. It comprises for this purpose a supply chamber for receiving a supply of the detergent and an extracting mechanism for extracting a dose of the detergent from the supply and for delivering the extracted dose into a fall channel. In order to assist with expelling an extracted dose of the detergent powder from the fall channel or/and to accelerate drying of the fall channel, the dosing system in some embodiments includes a fan for generating a blowing air stream which flows through at least parts of the fall channel.

8 Claims, 3 Drawing Sheets

DOMESTIC DISHWASHER AND DOSING SYSTEM THEREFOR

BACKGROUND OF THE INVENTION

1. Field of the Invention

The present invention relates generally to a dosing of a solid detergent in a domestic dishwasher.

2. Description of the Prior Art

In domestic dishwashers, the trend is towards accommodating in the machine a larger supply of the detergent (which typically contains surfactants, bleaching agents, enzymes, etc.) that is responsible for the cleaning action, and removing a suitable amount of the detergent from this supply as required by means of a dosing system and feeding it to the dishwashing operation. In the case of liquid rinsing substances, such storage in the dishwasher is conventionally known. The trend is towards providing such storage in the dishwasher for solid detergents too. The storage of a larger amount of the detergent in the dishwasher makes operation simpler for the user, because he only has to be concerned with occasionally, comparatively infrequently, renewing the supply. Particularly when the solid detergent is in powder form, operation is made considerably simpler for the user, because he no longer has to be concerned with introducing an amount of a detergent powder measured out by eye or by other means into a powder compartment of the dishwasher that is conventionally provided on the inside of the machine door.

In the case of such a conventional powder compartment on the inside of the door, a cover of the powder compartment springs open at a specific time after the start of a cleaning program of the dishwasher. The detergent powder located therein is then flushed out of the powder compartment by means of the dishwashing water and thus mixes with the dishwashing liquor of the dishwasher. Even when the powder compartment is washed out in this manner, it can happen that some of the detergent powder is left behind in the powder compartment, where it forms clumps and is ultimately not available for cleaning the dishes. In view of the hot and wet conditions inside the dishwashing chamber of the dishwasher in cleaning operation, the development of incrustations as a result of clump formation is a permanent issue when using a detergent in powder form. This is equally the case when the dishwasher is equipped with an automatic dosing system which performs a dosed removal of detergent from a larger supply. Heat and moisture from splashing dishwashing water and hot steam in the dishwashing chamber of the dishwasher can adversely affect the stored detergent if it is not adequately protected.

SUMMARY OF THE INVENTION

It is an object of the present invention to show a way in which, in a solid dosing device for a domestic dishwasher, the risk of the detergent being adversely affected by heat and moisture can be counteracted. It is a further object of the invention, in a powder dosing device of a domestic dishwasher, to avoid clump formation not only in the powder supply itself but also along the dosing line.

In order to achieve this object, the invention provides a dosing system for a detergent in powder form, wherein the dosing system comprises a supply chamber for receiving a supply of the detergent, an extracting mechanism for extracting a dose of the detergent from the supply and for delivering the extracted dose into a fall channel, and a fan for generating a blowing air stream. According to one aspect of the invention, a pressure side of the fan is in permanently open communication with at least parts of the fall channel. According to another aspect of the invention, which can be implemented alternatively or in addition, the extracting mechanism has a movably arranged extracting member having at least one dosing pocket dimensioned to receive a dose of the detergent, wherein, by driving the extracting member, the dosing pocket is movable from a receiving position, in which the dosing pocket is open towards the supply chamber, into a delivery position, in which the dosing pocket is open towards the fall channel, wherein a blowing air inlet which is able to be charged with blowing air by the fan opens into the fall channel downstream—based on the direction of fall of the detergent in the fall channel—of the extracting member.

In the solution according to the invention, the blowing air can be used to accelerate or assist with drying of the fall channel, the channel walls of which can become wet during execution of a cleaning program of a dishwasher equipped with the dosing system as a result of hot steam entering the fall channel or/and dishwashing water entering or being actively sprayed into the fall channel. Alternatively or in addition, the blowing air can be used to expel an extracted powder dose from the fall channel with the assistance of blowing air. The blowing air can thereby blow the fall channel virtually clean, so that no or at most only slight powder residues stick to the channel walls and the entire dose of detergent powder is instead expelled from the fall channel. This prevents the development of incrustations due to clumped detergent powder on the channel walls.

The introduction of blowing air, which is generated by the fan, into the fall channel makes it possible to some extent to create a fluidic barrier against the rise of hot steam in the fall channel. The blowing air introduced into the fall channel can prevent or at least reduce the extent to which hot steam is able to enter the region of the extracting mechanism and in some circumstances even the supply chamber through the fall channel. In the first aspect of the invention, because of the permanently open communication, blowing air enters the fall channel as soon as the fan is activated. The blowing air that is introduced does not have to fill the entire fall channel or reach all parts of the fall channel; it can be sufficient if the fan is active at least during specific operating phases of a domestic dishwasher equipped with the dosing system but, owing to a blockage of the fall channel, the blowing air reaches only a portion of the fall channel located above or below the blockage point. Even this can be sufficient to protect the detergent supply in the supply chamber of the dosing system from moisture and heat. In phases in which the fall channel is open, sufficient blowing air can be introduced into the fall channel to prevent hot steam from entering the fall channel at all if possible. Depending on whether the fall channel is blocked or open, a fan controller can therefore be adapted to operate the fan at different speeds, for example, in order to generate a blowing air flow of differing intensity.

In some embodiments, the blowing air inlet opens into the fall channel upstream of a blocking element. This blocking element is arranged so as to be movable between a blocking position, which blocks the fall channel so that detergent cannot fall through, and a freeing position, which frees the fall channel so that detergent can fall through. In its blocking position, the blocking element, which is formed, for example, by a linearly movable blocking slide, is to prevent the ingress of hot steam or/and splash water into the parts of the fall channel that are located upstream of the blocking element. However, in some circumstances it will not be possible to ensure perfect sealing by the blocking element, for which reason, at least in some embodiments, account will have to be taken of the fact that moisture can be deposited on the channel walls also in the parts of the fall channel that are located upstream of the blocking element. The location of the opening point (blowing air inlet), at which the blowing air inlet opens into the fall channel, upstream of the blocking element then allows such upstream parts of the fall channel to be dried by the blowing air generated by the fan.

In some embodiments, the extracting member is arranged so as to be rotatable about an axis of rotation and has a plurality of dosing pockets which are distributed in the circumferential direction and are each dimensioned to receive a dose of the detergent. By rotation of the extracting member, each dosing pocket can be moved from a receiving position, in which the dosing pocket in question is open towards the supply chamber, into a delivery position, in which the dosing pocket in question is open towards the fall channel. As a dosing pocket moves from the receiving position into the delivery position (by rotation of the extracting member), multiple other dosing pockets of the extracting member pass the receiving position.

A further aspect of the invention relates to a dosing system for a solid detergent, comprising a hollow-chamber arrangement which comprises a supply chamber for receiving a supply of the detergent and a fall channel for discharging, in particular by gravity, a portion of the detergent extracted from the supply to an outlet opening, wherein the dosing system further comprises a blocking member which is arranged so as to be movable between a blocking position and a freeing position and which, in the freeing position, frees the fall channel so that an extracted portion of the detergent can fall through it to the outlet opening and, in the blocking position, blocks the fall channel so that an extracted portion of the detergent cannot fall through it to the outlet opening. According to the invention, there is provided in this aspect a fan for supplying at least parts of the hollow-chamber arrangement with blowing air, wherein the fan is controlled in such a manner that it is active at least during a phase in which the blocking member is in the freeing position.

The solid detergent can be in powder form or it can be in the form of detergent tablets, which are conventionally produced by compacting a substance that is originally in powder form into bodies of a defined shape (frequently of an approximately cuboid shape). In the case of a pourable detergent in the form of a powder, the blowing of an air stream into the fall channel can be useful for expelling the detergent powder with the assistance of blowing air and for cleaning the fall channel of any powder residues. The introduction of a blowing air stream into the fall channel or/and into other regions of the hollow-chamber arrangement can, however, also be advantageous in the case of detergents in tablet form. The aspect of blowing-air-assisted delivery may not be of primary importance in the case of detergent tablets, especially if the detergent tablets have sufficient own weight that they fall safely and reliably through the entire fall channel solely by gravity. However, it is nevertheless a desirable aim to protect the tablet supply from hot moisture. Particularly when the blocking member frees the fall channel, that is to say the fall channel is open, the risk of splash water or/and steam entering the fall channel and in some circumstances reaching the detergent supply is high. At least when the blocking member is in its freeing position, it is therefore recommended to actively introduce into the hollow-chamber arrangement a blowing air stream which can counteract the ingress of steam and/or splash water.

It can, however, also be advantageous to actively introduce a blowing air stream into the hollow-chamber arrangement additionally when the blocking member is in the blocking position. This is because defects in tightness can generally not be ruled out completely, for example closing that is not perfectly tight of a maintenance cover which can be opened in order to free an access opening through which a user can manually access at least parts of the hollow-chamber arrangement. The blocking member may also not block the fall channel perfectly tightly in some circumstances. As a result of such defects in tightness, undesirable moisture can enter the hollow-chamber arrangement and where possible penetrate as far as the region of the supply chamber even when the blocking member is in its blocking position. It can therefore be desirable to allow the fan to run continuously over a prolonged period which lasts far longer than the comparatively short phase during which the blocking member is in its freeing position.

The invention additionally provides a dosing system for a solid detergent, comprising a hollow-chamber arrangement which forms a supply chamber for receiving a supply of the detergent and a fall channel for discharging a portion of the detergent extracted from the supply to an outlet opening, and a fan for supplying blowing air to at least parts of the hollow-chamber arrangement. The dosing system is characterized by a configuration or/and operational control which ensure(s) that blowing air is supplied to parts of the hollow-chamber arrangement that are located on the far side of (outside) the supply chamber. Blowing air is not only required inside the supply chamber for controlling the ingress and deposition of moisture. An extracting chamber arranged between the supply chamber and the fall channel, for example, in which extracting chamber there is received a movably arranged extractor for extracting a portion of the detergent from the supply and for delivering the extracted portion into the fall channel, is in some embodiments also to be kept free of moisture in the best possible manner. Similarly, protection against the ingress of moisture can also be desirable in the case of a chamber which is manually accessible to a user via a maintenance opening which is covered by a cover element which is removable or able to be moved away. The parts of the hollow-chamber arrangement that are supplied with blowing air can therefore include such chambers, whereby the supply chamber can of course additionally also be capable of being charged with blowing air by the fan.

The invention further provides a domestic dishwasher having a machine body delimiting a dishwashing chamber, a door mounted on the machine body about a pivot axis close to the floor, and a dosing system of the type discussed hereinbefore arranged on the door. In such a dishwasher, not only are the supply chamber and—where present—the extracting mechanism arranged on the door, but also the fan. The extracting mechanism and the fan can be part of a modular dosing unit which is able to be preassembled and which at the same time forms the supply chamber and, as a modular unit, can be mounted on the door of the dishwasher or fitted into the door.

The invention additionally provides a domestic dishwasher having a machine body delimiting a dishwashing chamber, a door mounted on the machine body about a pivot axis close to the floor, and a dosing system arranged on the door, wherein the dosing system comprises a supply chamber for receiving a supply of a solid detergent and a fall channel for discharging, under gravity, a portion of the detergent extracted from the supply to an outlet opening. Such a dishwasher is equipped according to the invention with a fan which serves to generate a blowing air stream into the fall channel or/and into the supply chamber, wherein the fan is controlled in such a manner that it is active in at least one of the following phases:

- a phase in which a portion of the detergent is delivered into the fall channel by the dosing system, in particular for expelling the detergent from the fall channel with the assistance of blowing air;
- a phase following completion of a dishwashing operation during execution of a cleaning program of the dishwasher, in particular during or after a drying phase of the cleaning program.

In some embodiments, the dosing system comprises a blocking element which is arranged so as to be movable between a blocking position, which blocks the fall channel so that detergent cannot fall through, and a freeing position, which frees the fall channel so that detergent can fall through. The fan can be controlled in such a manner that it is activated while an operating program of the dishwasher is running in dependence on a transfer of the blocking element into its freeing position or/and that, while an operating program of the dishwasher is running, it is always active when the blocking element is in the freeing position. Such an activation pattern of the fan can be useful during dishwashing operation of the dishwasher when, after opening of the blocking element, there is an increased risk that splash water or/and steam will enter the fall channel and in some circumstances pass from there into the supply chamber. As soon as the blocking element is opened (i.e. is transferred into its freeing position), it can therefore be expedient also to activate the fan (at the same time as the blocking element is opened, shortly before, or shortly after). This can on the one hand counteract the rise of moisture in the fall channel. On the other hand, moisture that may previously have entered the fall channel through any untight points into regions upstream of the blocking element can be expelled from the fall channel.

Activation of the fan in dependence on the opening of the blocking element can be carried out each time the blocking element is opened, for example during a dishwashing operation or/and during a drying operation or/and on completion of a drying operation of the dishwasher. Opening the blocking element can serve the purpose of delivering a portion of the detergent (e.g. a powder dose or a tablet). Alternatively or in addition, the blocking element can be opened specifically for the purpose of expelling moisture that has already entered the fall channel, without a portion of the detergent having to be delivered at the same time. At least when the blocking element is opened during a dishwashing operation of the dishwasher, it can be expedient to keep the fan active substantially during the entire time that the blocking element is not completely closed.

The fan can be active not only when the blocking element is open, but the fan can additionally be controlled in such a manner that it is active during a phase in which the blocking element is closed, that is to say is in its blocking position. Activation of the fan when the blocking element is closed can be useful, for example, in order to take account of any defects in tightness, which can lead to moisture entering the fall channel upstream of the blocking element despite the blocking element being closed and in some circumstances migrating upwards from there into the supply chamber. By actuating the fan with the blocking element closed, a slight excess pressure can be built up in the parts of the dosing system extending from the supply chamber to the blocking element, which prevents steam from entering through any untight points. It is thus conceivable in particular to allow the fan to run substantially during the entire wet phase, in which dishwashing water of the dishwashing liquor is sprayed in the dishwashing chamber of the dishwasher. The fan can thereby run constantly without interruption, whereby brief interruptions are of course not harmful. In some embodiments it is even provided that the fan runs beyond the wet phase in a drying phase in which, following completion of the dishwashing operation, the cleaned dishes are dried by active drying measures of the dishwasher.

According to a further aspect, the invention provides a domestic dishwasher which comprises a machine body delimiting a dishwashing chamber, a door mounted on the machine body about a pivot axis close to the floor, a dosing system for a solid detergent arranged on the door, and a control unit for controlling the dosing system. The dosing system has a supply chamber for receiving a supply of the detergent and an extracting mechanism for extracting a portion of the detergent from the supply and for delivering the extracted portion into a fall channel. The control unit is adapted to effect the delivery of a changeable number of portions of the detergent during execution of a cleaning program of the dishwasher. For example, the control unit can cause a first portion of the detergent to be delivered during an initial phase of a cleaning program and can cause a second portion of the detergent to be delivered at a later point in time if required, wherein the control unit is able to assess the need for the second portion, for example, on the basis of information about current properties of the dishwashing liquor (e.g. turbidity) determined by sensors. The portions of the detergent can always contain substantially the same, defined amount of detergent. For example, in the case of a detergent powder, each portion can correspond to a pocket charge of a dosing pocket of an extracting member, designed with multiple such dosing pockets, of the extracting mechanism.

The invention will be explained further hereinbelow with reference to the accompanying drawings.

DETAILED DESCRIPTION OF THE INVENTION

Figure 1:
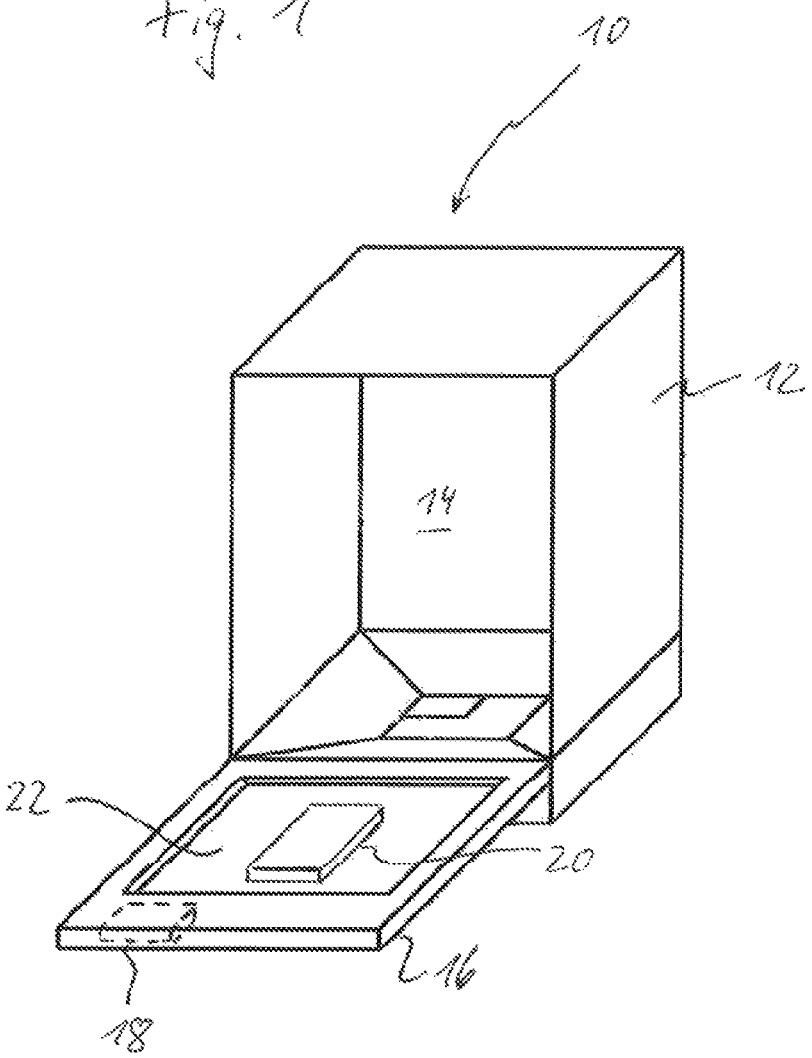
FIG. 1 shows, schematically, a domestic dishwasher having a powder dosing system according to an exemplary embodiment.

Reference will first be made to FIG. 1. The dishwasher illustrated therein, which is intended for domestic use, is designated generally 10. It comprises a machine body (dishwashing container) 12 in which a dishwashing chamber 14 is formed. There is mounted on the machine body 12 a door 16 which is pivotable about a horizontal pivot axis (not shown) close to the floor. One or more crockery baskets and optionally a cutlery drawer for receiving the items of crockery and cutlery that are to be cleaned can be inserted in a manner known per se into the dishwashing chamber 14. A control unit 18 is responsible for controlling operation of the dishwasher 10. In the example shown, the control unit 18 is fitted into the door 16. It will be appreciated that in other embodiments the control unit 18 can be arranged on the machine body 12.

The control unit 18 is responsible not only for controlling the dishwashing operation and optionally a drying operation of the dishwasher 10 but also for controlling a powder dosing system 20 by means of which a suitably dimensioned powder dose can be removed from a supply of a detergent in powder form and delivered into the dishwashing chamber 14. The powder dosing system 20 is arranged on the door 16, wherein in the example shown it is not fitted in a concealed manner into the door but is placed on the outside of an inner lining panel 22 of the door 16 and fastened thereto. The powder dosing system 20 has an outlet opening (not shown in FIG. 1), from which the dosed amount of powder falls from the powder dosing system 20. In dishwashing operation of the dishwasher 10, the detergent powder that falls out or that has fallen out is picked up and carried along by the dishwashing water. It will be appreciated that in other embodiments the powder dosing system 20 can be fitted into the door 16 in such a manner that it is concealed behind the inner lining panel 22, wherein the extracted powder dose then falls out of the door 16 into the dishwashing chamber 14 through an outlet opening formed in the inner lining panel 22, for example as part of a hood.

Figure 2:
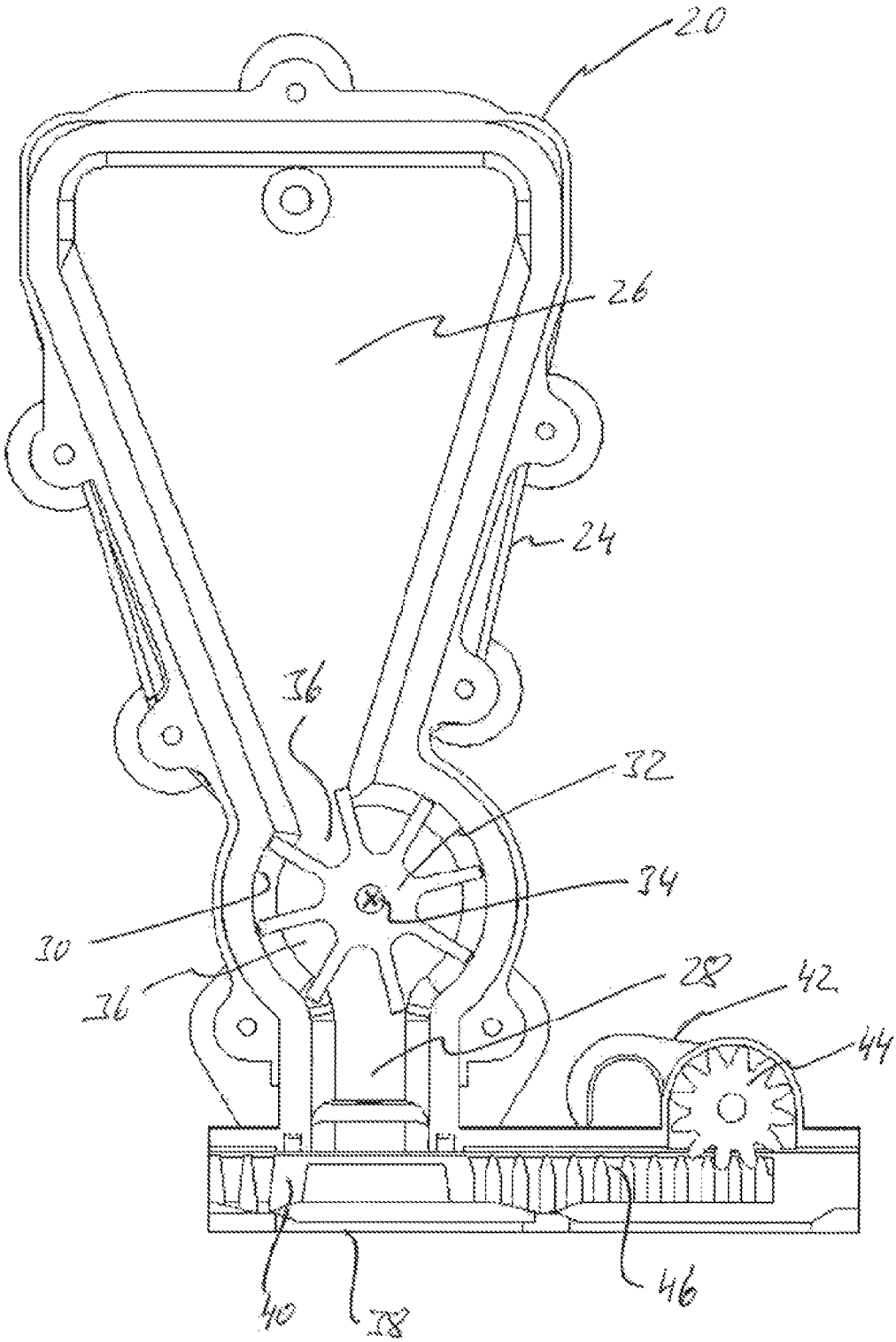
FIG. 2 shows, in a sectional view, an exemplary embodiment of the powder dosing system of FIG. 1.
Figure 3:
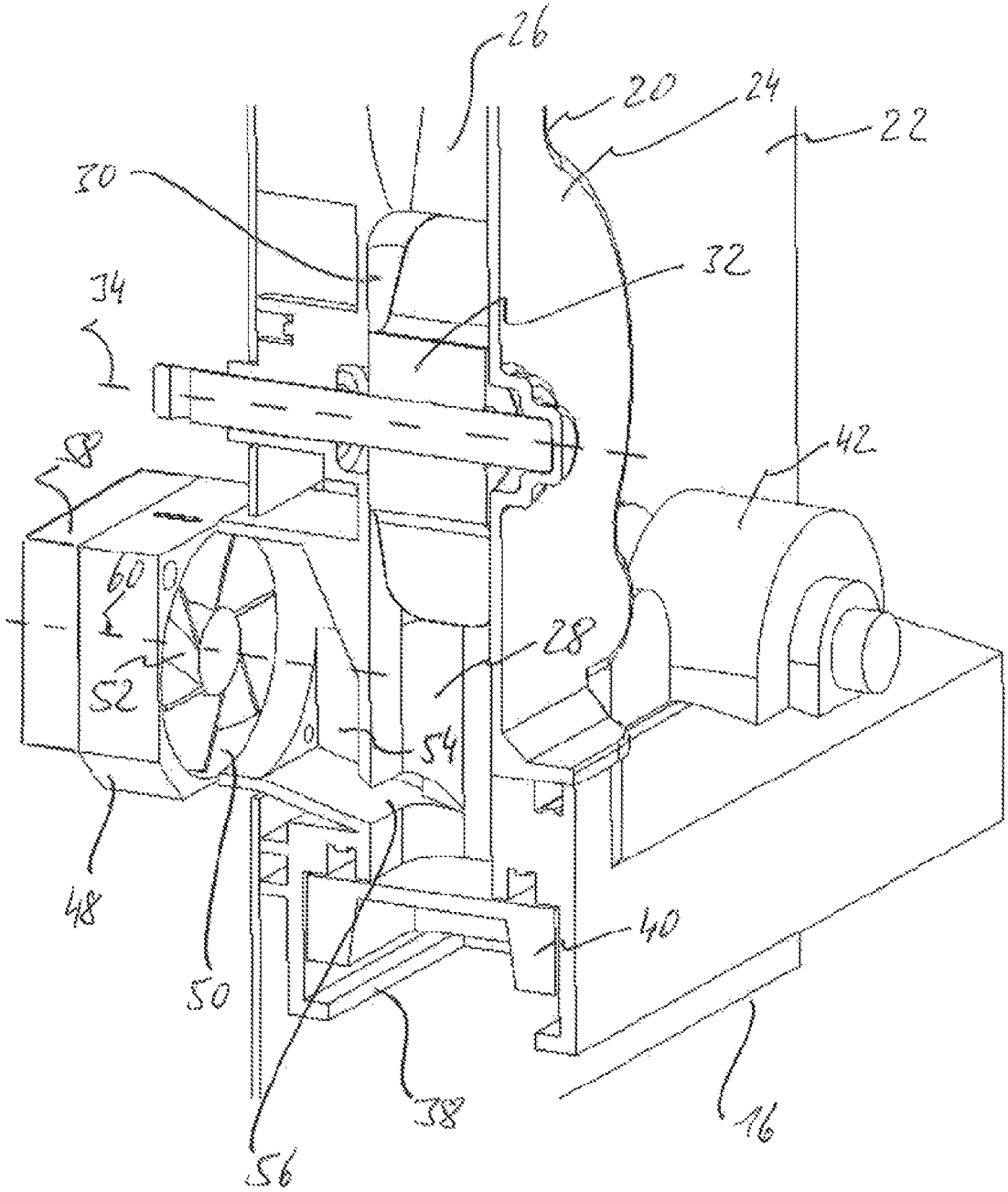
FIG. 3 is a partially cutaway perspective view of a detail of the powder dosing system of FIG. 2.

Reference will now additionally be made to FIGS. 2 and 3. The powder dosing system 20 according to the exemplary embodiment of FIGS. 2 and 3 can be preassembled as a modular unit and mounted on the door 16 of the dishwasher 10 as a preassembled modular unit. In the exemplary embodiment of FIGS. 2 and 3, the powder dosing system 20 comprises a system housing 24 in which there is formed a connected hollow-chamber arrangement 25, which in the example shown forms a supply chamber 26, which tapers downwards in the manner of a funnel, and a fall channel 28 arranged beneath the supply chamber 26. The supply chamber 26 serves to store a larger amount of the detergent powder. At the lower end of the funnel, the supply chamber 26 opens into a dosing chamber 30 (extracting chamber), in which a powder dosing wheel 32 (extractor) is received so as to be rotatable about an axis of rotation 34. The powder dosing wheel 32 forms a plurality of dosing pockets 36 which are arranged distributed in the circumferential direction and are open radially towards the outside and each of which is dimensioned to receive a defined dose of the detergent powder. The powder dosing wheel 32 is able to be driven about the axis of rotation 34 by means of an electrically controllable, in particular electromotive dosing drive unit, not shown in the drawings. The powder dosing wheel 32 and the dosing drive unit together form an extracting mechanism within the meaning of the present disclosure.

The fall channel 28 opens from the dosing chamber 30 at an angular distance from the region in which the supply chamber 26 opens into the dosing chamber 30. By rotating the powder dosing wheel 32, a powder dose which has slid by gravity out of the supply chamber 26 into one of the dosing pockets 36 can be conveyed into the region of the start of the fall channel 28. The powder dose there falls out of the dosing pocket 36 in question (provided that the door 16 is closed) and then falls down in the fall channel 28 in the direction towards an outlet opening 38 formed by the system housing 24, at which outlet opening the powder dose leaves the powder dosing system 20.

The powder dosing system 20 additionally contains a blocking slide 40, which is adjustable by means of an electrically controllable, in particular electromotive slide drive unit 42 between a blocking position and a freeing position. In FIGS. 2 and 3, the blocking slide 40 is in its blocking position; in this position, the blocking slide 40 blocks the passage through the fall channel 28. In the freeing position, on the other hand, the blocking slide 40 frees the fall channel 28, so that detergent powder is able to fall in the fall channel 28 to the outlet opening 38. In the example shown, the blocking slide 40 is in the form of a linear slide; it will be appreciated that this is only an exemplary form and that, for example, a configuration of the blocking slide as a rotary slide is conceivable as an alternative. In the example shown, the slide drive unit 42 comprises a drive pinion 44, for example a motor-driven drive pinion, which is in meshing engagement with a tooth system 46 of the blocking slide 40 (FIG. 2).

Most of the time during dishwashing operation of the dishwasher 10, the blocking slide 40 is in its blocking position in order to prevent water and hot steam from entering the dosing chamber 30 and from there, in some circumstances, entering the supply chamber 26. If detergent powder is to be delivered from the dosing system 20 into the dishwashing chamber 14, the blocking slide 40 is moved into its freeing position and thereby frees the fall channel 28 for the passage of detergent powder. After the detergent powder has been delivered, the blocking slide 40 is moved back into its blocking position again.

However, the blocking slide 40 is often not able to completely prevent the ingress of splash water or/and steam into the fall channel 28. It must be expected that moisture will be deposited on the channel walls of the fall channel 28 upstream of the blocking slide 40 and in some circumstances also on the powder dosing wheel 32 and on the channel walls of the dosing chamber 30. Such residual moisture can be troublesome specifically when a detergent in powder form is used, because it can lead to clumping of the detergent powder. In the exemplary embodiment of FIGS. 2 and 3, the powder dosing system 20 therefore comprises a fan 48 (FIG. 3) having an impeller 52 seated in a fan chamber 50. Adjoining the fan chamber 50 is a blowing air feed channel 54, which opens into the fall channel 28 at a permanently open opening point 56 (blowing air inlet). There is thus a permanently open connection between the fan chamber 50 and the fall channel 28. The opening point 56 is located upstream of the blocking slide 40 but downstream of the powder dosing wheel 32. With its pressure side, that is to say the axial side at which the blowing air is discharged from the impeller 52, the impeller 52 faces the blowing air feed channel 54.

The impeller 52 is able to be driven about an axis of rotation 60 by means of an electrically controllable, in particular electromotive fan drive unit 58, shown schematically in FIG. 3. In the example shown, the axis of rotation 60 runs substantially parallel to the axis of rotation 34 of the powder dosing wheel 32, wherein the two axes of rotation 34, 60 are oriented substantially perpendicularly to the plane of the door 16 in the finally mounted state of the powder dosing system 20 (i.e. when the powder dosing system 20 is mounted on the door 16).

The fan 48 is activated at least in some embodiments for at least two purposes.

A first purpose consists in expelling detergent powder, which is delivered from the powder dosing wheel 32 into the fall channel 28, from the fall channel with the assistance of blowing air. The blowing air is intended to assist the powder as it falls or/and to free portions of the powder that have stuck to the channel walls of the fall channel 28. The geometry of the blowing air feed channel 54 and of the opening point 56 is suitably configured to generate in the fall channel 28 a blowing air stream oriented in the direction towards the outlet opening 38 when the impeller 52 is actuated. This blowing air stream carries the detergent powder falling from the powder dosing wheel 32 in the direction towards the outlet opening 38 (when the blocking slide 40 is open, i.e. when the blocking slide 40 is in its freeing position) and thereby also prevents portions of the detergent powder from adhering and sticking to the walls of the fall channel 28. Expelling the detergent powder from the fall channel 28 with the assistance of blowing air reduces the tendency for the development of permanent powder residues on the walls of the fall channel 28.

A second purpose consists in drying the fall channel 28 by blowing in blowing air. As explained, the accumulation of moisture on the channel walls of the fall channel 28 and in the region of the dosing chamber 30 during dishwashing operation of the dishwasher 10 cannot be ruled out. In order to dispel such moisture, which also carries the risk of the formation and adhesion of powder clumps, the fan 48 can be activated during execution of a cleaning program of the dishwasher 10, after the end of the dishwashing operation, that is to say when water is no longer being sprayed into the dishwashing chamber 14. The fan 48 can be activated, for example, during a drying phase of the cleaning program, that is to say in an operating phase in which drying (in particular active drying) of the dishwashing chamber 14 and of the dishes located therein is carried out. Alternatively or in addition, the fan 48 can be activated once the drying phase is complete, in some circumstances even with a considerable time delay after the end of the drying phase. For example, it is conceivable to start up the fan 48 only several minutes or even several tens of minutes (e.g. half an hour or even a whole hour) after the end of the drying operation.

If the fan 48 is activated for drying purposes, the blocking slide 40 can be moved into its freeing position, at least in phases, while the fan is operating. The air blown into the fall channel 28 by means of the fan 48 can then escape via the outlet opening 38 into the dishwashing chamber 14. However, it is also possible to leave the blocking slide 40 in its blocking position, at least in phases, while the fan is operating in order thus to force or at least promote the ingress of blowing air also into the regions of the fall channel 28 that are located upstream of the opening point 56 and in some circumstances also into the dosing chamber 30. In this manner, the upstream parts of the fall channel 28 and optionally the dosing chamber 30 with the powder dosing wheel 32 located therein can also actively be dried by means of the blowing air. In order to avoid an accumulation of air, an air outlet opening (or multiple such air outlet openings), for example of slot shape, can be formed in the walls of the fall channel 28. Blowing air which is blown into the fall channel 28 by means of the fan 48 is able to escape from the fall channel 28 through such an outlet opening. It is thus possible, with the fall channel 28 blocked, by activating the fan 48, to generate a forced circulation of air from the interior of the door 16 through the blowing air feed channel 54 into the fall channel 28 and, via the mentioned air outlet opening(s), out of the fall channel 28 back into the interior of the door 16. With the fall channel 28 open (when the blocking slide 40 is in its freeing position), on the other hand, blowing air blown into the fall channel 28 can emerge into the dishwashing chamber 14 at the outlet opening 38.

In order move from a powder receiving rotational position, in which one of the dosing pockets 36 is situated at the opening point to the supply chamber 26 and is accordingly ready to accept detergent powder from the supply chamber 26, into a powder delivery rotational position, in which the dosing pocket 36 in question has been transferred to the opening point to the fall channel 28 and is accordingly ready to deliver the received detergent powder into the fall channel 28, the powder dosing wheel 32 must be rotated through a specific angle of rotation. In the exemplary embodiment shown, this angle of rotation is such that in the meantime (i.e. while the dosing pocket 36 in question is moving from the powder receiving rotational position into the powder delivery rotational position), at least two other dosing pockets 36 of the powder dosing wheel 32 pass the opening point to the supply chamber 26 and are filled with detergent powder. The powder dosing wheel 32 thus always has further extracted doses of the detergent powder available, which can be delivered into the fall channel 28 at any time by rotating the powder dosing wheel 32 further comparatively briefly. In some embodiments, this configuration of the powder dosing wheel 32 can be used to deliver a variable number of doses of the detergent powder into the dishwashing chamber 14 during execution of a cleaning program. For example, if, during execution of a cleaning program, the control unit 18 determines, on the basis of the signals of a turbidity sensor (not shown in the drawings) that measures the turbidity of the dishwashing liquor, that a first dose of the detergent powder was not sufficient to achieve a desired cleaning result, the control unit 18 can effect the delivery of a further powder dose by briefly rotating the powder dosing wheel 32 further. In this manner, a suitable number of powder doses can be delivered dependent on the situation.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A dosing system for a detergent in powder form, the dosing system comprising:

a supply chamber for receiving a supply of the detergent;

an extracting mechanism for extracting a dose of the detergent from the supply and for delivering the extracted dose into a fall channel; and a fan for generating a blowing air stream, wherein the extracting mechanism has a movably arranged extracting member having at least one dosing pocket dimensioned to receive a dose of the detergent, wherein, by driving the extracting member, the dosing pocket is movable from a receiving position, in which the dosing pocket is open towards the supply chamber, into a delivery position, in which the dosing pocket is open towards the fall channel, wherein a blowing air inlet which is able to be charged with blowing air by the fan opens into the fall channel downstream—based on the direction of fall of the detergent in the fall channel—of the extracting member.

2. The dosing system as claimed in claim 1, wherein the blowing air inlet opens into the fall channel upstream of a blocking element which is arranged so as to be movable between a blocking position, which blocks the fall channel so that detergent cannot fall through, and a freeing position, which frees the fall channel so that detergent can fall through.

3. The dosing system as claimed in claim 1, wherein the extracting member is arranged so as to be rotatable about an axis of rotation and has a plurality of dosing pockets which are distributed in the circumferential direction and are each dimensioned to receive a dose of the detergent, wherein, by rotation of the extracting member, each dosing pocket is movable from a receiving position, in which the dosing pocket in question is open towards the supply chamber, into a delivery position, in which the dosing pocket in question is open towards the fall channel, wherein, as a dosing pocket moves from the receiving position into the delivery position, multiple other dosing pockets of the extracting member pass the receiving position.

4. A dosing system for a detergent in powder form, the dosing system comprising:

a supply chamber for receiving a supply of the detergent;

an extracting mechanism for extracting a dose of the detergent from the supply and for delivering the extracted dose into a fall channel, wherein the fall channel is configured for discharging the extracted dose from the supply to an outlet opening;

a fan for generating a blowing air stream, wherein a pressure side of the fan is in permanently open communication with at least parts of the fall channel; and a hollow-chamber arrangement which forms the supply chamber for receiving the supply of the detergent;

wherein the fan is configured for supplying blowing air to at least parts of the hollow-chamber arrangement;

wherein at least one of a configuration and an operational control of the dosing system ensures that blowing air is introduced into parts of the hollow chamber arrangement that are located on a far side of the supply chamber; and wherein the parts of the hollow-chamber arrangement that are located on the far side of the supply chamber comprise an extracting chamber arranged between the supply chamber and the fall channel, in which extracting chamber there is received the extracting mechanism.

5. The dosing system as claimed in claim 4, wherein the parts of the hollow-chamber arrangement that are located on the far side of the supply chamber comprise a chamber having a maintenance opening, which chamber is covered by a cover element that is removable or able to be moved away.

6. A dosing system for detergent in power form, the dosing system comprising:

a supply chamber for receiving a supply of the detergent;

an extracting mechanism for extracting a dose of the detergent from the supply and for delivering the extracted dose into a fall channel, wherein the fall channel is configured for discharging the extracted dose from the supply to an outlet opening;

a fan for generating a blowing air stream, wherein a pressure side of the fan is in permanently open communication with at least parts of the fall channel;

a hollow-chamber arrangement which forms the supply chamber for receiving the supply of the detergent; and a blocking member arranged to be movable between:

a blocking position in which the blocking member blocks the fall channel so that the extracted dose cannot fall through the fall channel; and a freeing position in which the blocking member frees the fall channel so that the extracted dose can fall through the fall channel to the outlet opening.

7. The dosing system as claimed in claim 6, wherein the fan is configured for supplying blowing air to at least parts of the hollow-chamber arrangement, and wherein the fan is controlled to be active at least during a phase in which the blocking member is in the freeing position.

8. The dosing system as claimed in claim 7, wherein the fan is controlled to be additionally active during a phase in which the blocking member is in the blocking position.

* * * * *